US009638195B2

(12) United States Patent
Tian et al.

(10) Patent No.: US 9,638,195 B2
(45) Date of Patent: May 2, 2017

(54) CROSS FLOW FAN

(71) Applicants: SHANGHAI JIAOTONG UNIVERSITY, Shanghai (CN); DAIKIN INDUSTRIES, LTD., Osaka-shi, Osaka (JP)

(72) Inventors: Jie Tian, Shanghai (CN); Hua Ouyang, Shanghai (CN); You Li, Shanghai (CN); Hironobu Teraoka, Sakai (JP); Shimei Tei, Sakai (JP); Hideshi Tanaka, Kusatsu (JP)

(73) Assignees: SHANGHAI JIAOTONG UNIVERSITY, Shanghai (CN); Daikin Industries, Ltd., Osaka (JP)

( * ) Notice: Subject to any disclaimer, the term of this patent is extended or adjusted under 35 U.S.C. 154(b) by 421 days.

(21) Appl. No.: 14/354,902

(22) PCT Filed: Nov. 1, 2012

(86) PCT No.: PCT/JP2012/078353

§ 371 (c)(1),
(2) Date: Apr. 28, 2014

(87) PCT Pub. No.: WO2013/065792

PCT Pub. Date: May 10, 2013

(65) Prior Publication Data

US 2014/0301825 A1 Oct. 9, 2014

(30) Foreign Application Priority Data

Nov. 4, 2011 (CN) ..... 2011 1 0346484

(51) Int. Cl.
*F04D 17/04* (2006.01)
*F04D 29/30* (2006.01)
(Continued)

(52) U.S. Cl.
CPC ..... *F04D 17/04* (2013.01); *F04D 29/283* (2013.01); *F04D 29/30* (2013.01); *F04D 29/681* (2013.01);
(Continued)

(58) Field of Classification Search
CPC ..... F04D 17/04; F04D 29/023; F04D 29/283; B23K 26/00
See application file for complete search history.

(56) References Cited

U.S. PATENT DOCUMENTS 6,079,948 A * 6/2000 Sasaki ..... F01D 5/141 415/191
6,261,051 B1 * 7/2001 Kolacny ..... F01D 1/14 415/224
(Continued)

FOREIGN PATENT DOCUMENTS

JP 57-157788 U 10/1982
JP 2-169896 A 6/1990
(Continued)

OTHER PUBLICATIONS

International Preliminary Report of corresponding PCT Application No. PCT/JP2012/078353 dated Jun. 12, 2014.
(Continued)

*Primary Examiner* — Thai Ba Trieu
*Assistant Examiner* — Shafiq Mian
(74) *Attorney, Agent, or Firm* — Global IP Counselors, LLP

(57) ABSTRACT

A cross flow fan includes a support plate and an impeller with a plurality of blades disposed on the support plate at predetermined intervals. On each blade, a radius of a pressure surface arc is greater than a radius of a suction surface arc, a radius of an inner peripheral side arc is greater than a radius of an outer peripheral side arc, and a region of
(Continued)

maximum thickness is located 40% to 60% from the inner peripheral side arc in the lengthwise direction. The blades are disposed such that the inner peripheral side arcs are positioned on an inner peripheral side of the support plate and the outer peripheral side arcs are positioned on an outer peripheral side of the support plate. A flow path width between the plurality of blades gradually decreases from the inner peripheral side toward the outer peripheral side of the support plate.

8 Claims, 19 Drawing Sheets

(51) Int. Cl.
*F04D 29/28* (2006.01)
*F04D 29/68* (2006.01)
*F24F 1/00* (2011.01)

(52) U.S. Cl.
CPC ..... *F24F 1/0025* (2013.01); *F05D 2240/304* (2013.01)

(56) References Cited

U.S. PATENT DOCUMENTS 7,223,075 B2 * 5/2007 Schmitt ..... F01D 5/141 239/224
7,422,418 B2 9/2008 Ishijima et al.
9,039,362 B2 * 5/2015 Fukuda ..... F04D 25/0613 415/206
9,051,839 B2 * 6/2015 Senoo ..... F01D 5/141 415/206
9,267,591 B2 * 2/2016 Okaji ..... F16H 41/26 415/206
2006/0018750 A1 * 1/2006 Ishijima ..... F04D 29/30 415/53.1
2012/0177477 A1 * 7/2012 Shiraichi ..... F04D 17/04 415/53.1

FOREIGN PATENT DOCUMENTS

JP 2004-100663 A 4/2004
JP 4583095 B2 9/2010
JP 2476908 A1 * 7/2012 ..... F04D 17/04

OTHER PUBLICATIONS

International Search Report of corresponding PCT Application No. PCT/JP2012/078353.
European Search Report of corresponding EP Application No. 12 84 4871.9 dated Jun. 22, 2015.

* cited by examiner

CROSS FLOW FAN

CROSS-REFERENCE TO RELATED APPLICATIONS

This U.S. National stage application claims priority under 35 U.S.C. §119(a) to Chinese Patent Application No. 201110346484.1, filed in China on Nov. 4, 2011, the entire contents of which are hereby incorporated herein by reference.

TECHNICAL FIELD

The present invention relates to a cross flow fan and an air conditioning apparatus equipped with the cross flow fan.

BACKGROUND ART

Cross flow fans are used in blowers of indoor units of air conditioning apparatus. A cross flow fan is equipped with an impeller that has a circular plate and plural blades disposed on the outer periphery of the plate. FIG. 15 shows the cross-sectional shape of a blade of a cross flow fan disclosed in Japanese Utility Model Application Laid-open No. S57-157788 and Japanese Patent Application Laid-open No. H2-169896. As shown in FIG. 15, the cross-sectional shape of a blade 500 is a crescent shape that is bilaterally symmetrical about a centerline (the long dashed short dashed line), is thick in the center, and is thin at both ends. In this kind of blade whose cross section has a crescent shape, the radii of an outer peripheral side arc Ro and an inner peripheral side arc Ri of the blade are equal, a convex surface side arc Rs and a concave surface side arc Rp of the blade are each configured by single arcs, and Rp>Rs. However, in a case where a blade whose cross section has a crescent shape is employed as the blades of a cross flow fan, as shown in FIG. 16, in flow paths between the plural blades, a flow path diameter Di on the inner peripheral side of the blades is decreased to a flow path diameter Do' on the outer peripheral side of the blades, and the change in the flow path width from the inner peripheral side to the outer peripheral side of the blades is great, so the change in the air flow speed becomes greater. Specifically, as shown in FIG. 17, the flow path width on the outer peripheral side becomes 24.3% narrower, and flow velocities become greater on the outlet side. Thus, air flow turbulence becomes greater, it becomes difficult for the air flows to flow along the flow paths, and flow separation occurs on the outlet side suction surfaces. As a result, power loss caused by the fan increases.

Furthermore, in a cross flow fan disclosed in Japanese Patent No. 4,583,095, in order to suppress noise and an increase in motor input caused by flow separation at blade surfaces at times of high pressure loss, there is disclosed a cross flow fan blade shape which, in a case where the chord length is equally divided, forms a streamline that is asymmetrical with respect to the division line, with the ratio of a fan inner peripheral side cross-sectional area Sa to a fan outer peripheral side cross-sectional area Sb being equal to 1.3 to 1.6 (Sa/Sb=1.3 to 1.6), the ratio of a dimension Rb of a fan outer peripheral side distal end R to a dimension Ra of a fan inner peripheral side distal end R being equal to 0.1 to 0.8 (Rb/Ra=0.1 to 0.8), and the blade cross-sectional thickness reaching a maximum in the center of the chord length. However, in a blade with this shape, the flow path width between adjacent blades does not gradually decrease from the inner peripheral side toward the outer peripheral side, and there are sections where the change in air flow speed is not stable.

SUMMARY

Technical Problem

Therefore, it is a problem of the present invention to provide a cross flow fan which, by increasing the flow path width between adjacent blades on the outer peripheral side of the fan to reduce the decrease rate of the flow path width between the adjacent blades from the inner peripheral side to the outer peripheral side of the blades, reduces the change in air speed from the inner peripheral side to the outer peripheral side of the blades and in which there is little power loss caused by the fan.

Solution to Problem

Across flow fan pertaining to a first aspect of the present invention is equipped with a support plate and an impeller that is formed by plural blades. The plural blades are disposed on the support plate portion at predetermined intervals. A lengthwise direction cross-sectional shape of each of the blades has a suction surface arc that forms a convex suction surface, a pressure surface arc that forms a concave pressure surface, an inner peripheral side arc that interconnects a first end of the suction surface arc and a first end of the pressure surface arc, and an outer peripheral side arc that interconnects a second end of the suction surface arc and a second end of the pressure surface arc. Furthermore, a radius of the pressure surface arc is great r than a radius of the suction surface arc, a radius of the inner peripheral side arc is greater than a radius of the outer peripheral side arc, and a region of maximum thickness of the blade is located in a position 40% to 60% from the inner peripheral side arc in the lengthwise direction. Furthermore, the blades are disposed in such a way that the inner peripheral side arcs are positioned on an inner peripheral side of the support plate and the outer peripheral side arcs are positioned on an outer peripheral side of the support plate, and a flow path width between the plural blades gradually decreases from the inner peripheral side toward the outer peripheral side of the support plate.

Because of this structure, the outer peripheral sides of the blades become thinner and the flow path width between the adjacent blades on the outer peripheral side of the fan can be increased. Furthermore, the flow path width between the adjacent blades gradually decreases across the entire length from the inner peripheral side to the outer peripheral side of the blades, the change in air speed from the inner peripheral side to the outer peripheral side of the blades can be reduced, and a lowering of the blowing performance of the fan can be suppressed.

A cross flow fan pertaining to a second aspect of the present invention is the cross flow fan of the first aspect of the present invention, wherein the suction surface of each of the blades is configured by a single suction surface arc Rs, the pressure surface is configured by plural pressure surface arcs Rp1, Rp2, . . . , Rpn, and radii rp1, rp2, . . . , rpn of the plural pressure surface arcs Rp1, Rp2, . . . , Rpn are each greater than the radius rs of the suction surface arc Rs.

In this case, the pressure surface of each of the blades is configured by plural arcs, and the radii of these plural arcs are each greater than the radius of the suction surface arc. Consequently, the decrease rate of the flow path width between the plural blades on the inner peripheral side of the blades becomes even smaller, the change in air speed from the inner peripheral side to the outer peripheral side of the blades can be reduced, and a lowering of the blowing performance of the fan can be suppressed.

A cross flow fan pertaining to a third aspect of the present invention is the cross flow fan of the second aspect of the present invention, wherein the sizes of the radii rp1, rp2, . . . , rpn of the plural pressure surface arcs Rp1, Rp2, . . . , Rpn are such that rp2>rp3> . . . >rpn>rp1, and the thickness of each of the blades becomes smaller in stages from the region of maximum thickness toward the outer peripheral side arc Ro.

In this case, the pressure surface of each of the blades is configured by plural arcs, and the thickness of each of the blades becomes smaller in stages from the region of maximum thickness toward the outer peripheral side arc Ro. Consequently, the decrease rate of the flow path width between the plural blades from the inner peripheral side to the outer peripheral side of the blades becomes even smaller, the change in air speed from the inner peripheral side to the outer peripheral side of the blades can be reduced, and a lowering of the blowing performance of the fan can be suppressed.

A cross flow fan pertaining to a fourth aspect of the present invention is the cross flow fan according to any of the first to third aspects of the present invention, wherein a maximum percentage decrease of the flow path width between the plural blades is 20% or less.

An air conditioning apparatus indoor unit pertaining to a fifth aspect of the present invention is equipped with the cross flow fan pertaining to the fourth aspect of the present invention, a heat exchanger, and a casing.

An air conditioning apparatus pertaining to a sixth aspect of the present invention is equipped with the indoor unit pertaining to the fifth aspect of the present invention, an outdoor unit, and a pipe that interconnects the indoor unit and the outdoor unit.

Advantageous Effects of Invention

The cross flow fan pertaining to the present invention can, by reducing the decrease rate of the flow path width between the plural blades, reduce the change in air speed from the inner peripheral side to the outer peripheral side of the blades and can suppress a lowering of the blowing performance of the fan.

DESCRIPTION OF EMBODIMENTS

An air conditioning apparatus and an indoor unit that serve as an example of devices equipped with a cross flow fan pertaining to an embodiment of the present invention will be described below using FIG. 1.

Embodiment 1

Overall Configuration of Air Conditioning Apparatus

Figure 1:
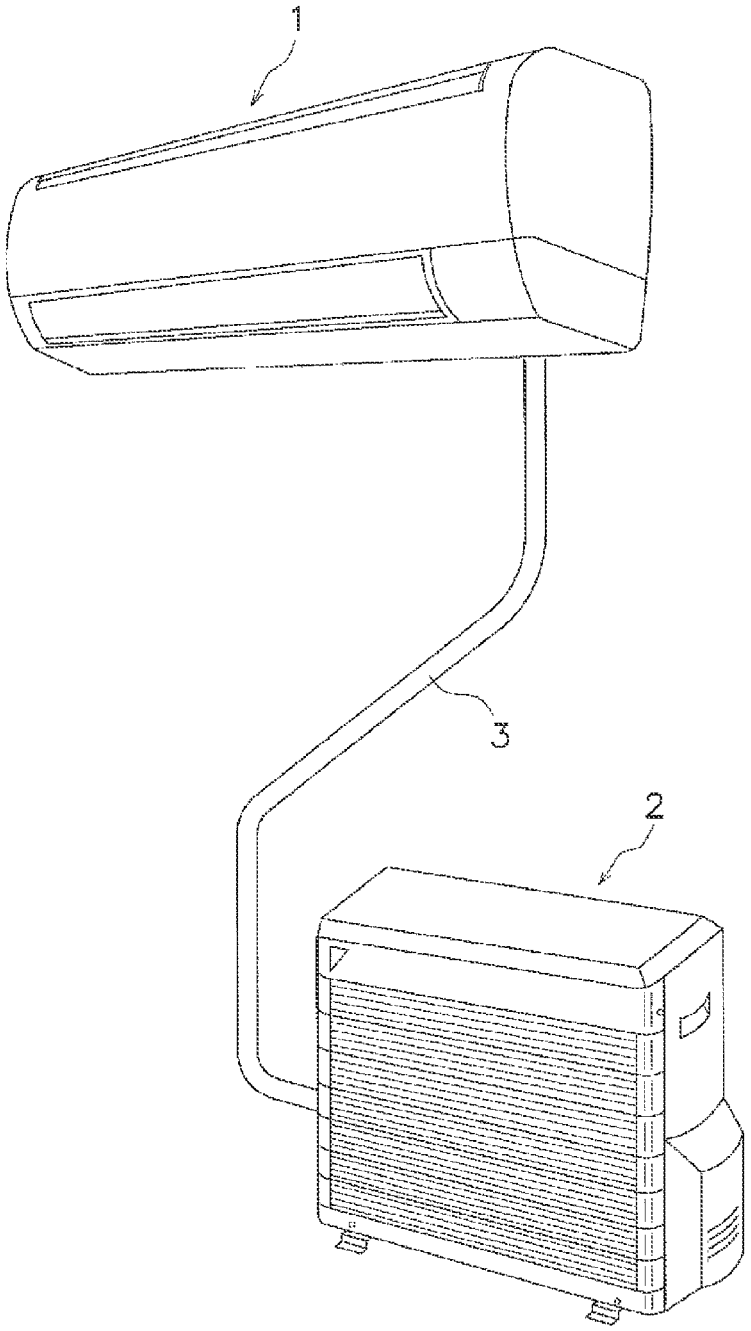
FIG. 1 is an external perspective view of an air conditioning apparatus equipped with a cross flow fan pertaining to embodiments of the present invention.

FIG. 1 shows the external appearance of an air conditioning apparatus equipped with a cross flow fan that is an embodiment of the present invention.

The air conditioning apparatus is an apparatus for supplying conditioned air to a room. The air conditioning apparatus is equipped with an indoor unit 1, which is attached to a wall surface or the like in a room, and an outdoor unit 2, which is installed outdoors.

An indoor heat exchanger is housed in the indoor unit 1, and an outdoor heat exchanger not shown in the drawings is housed in the outdoor unit 2. Furthermore, the indoor heat exchanger and the outdoor heat exchanger are interconnected by a refrigerant pipe 3 to configure a refrigerant circuit.

<Configuration of Indoor Unit>

Figure 2:
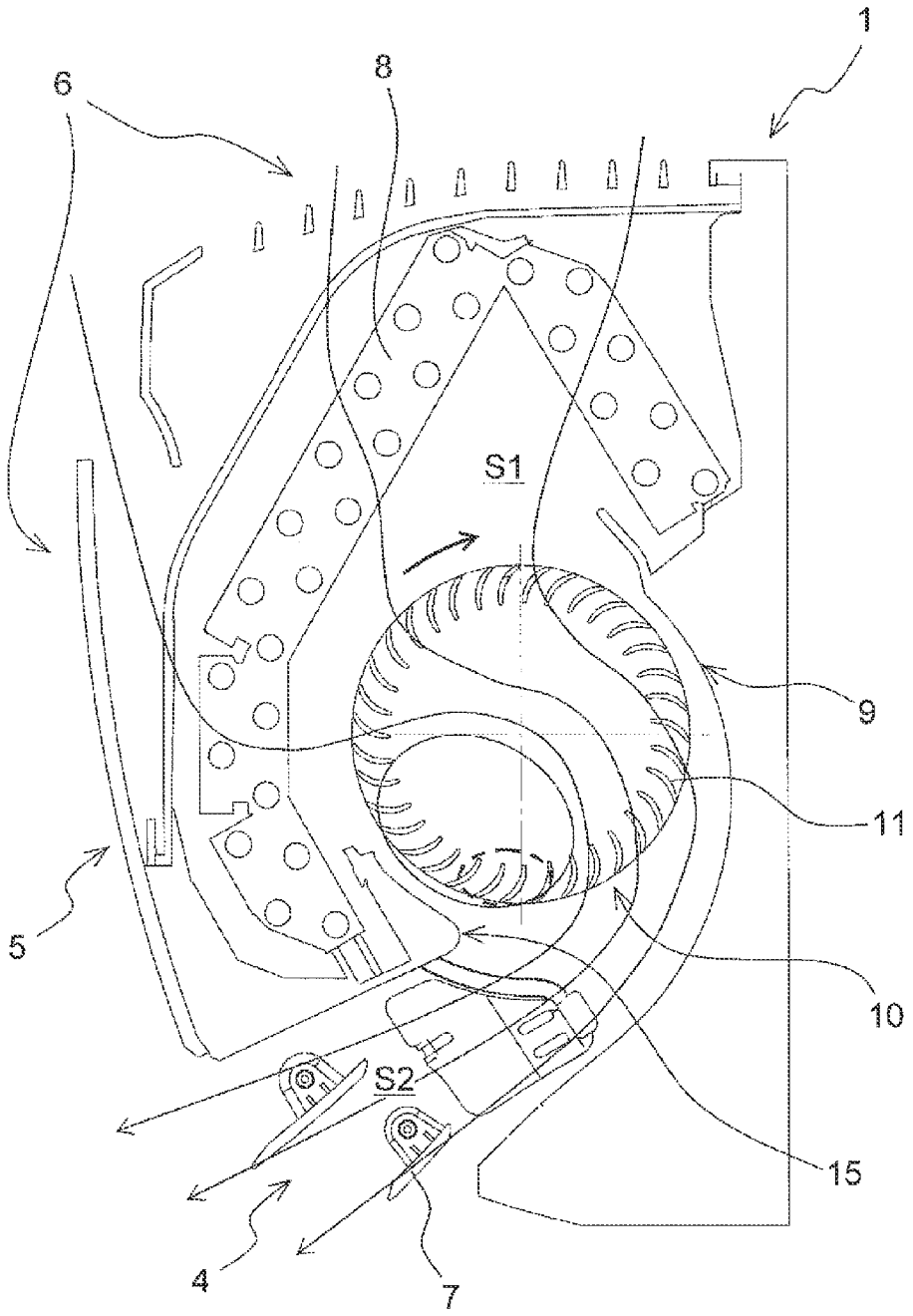
FIG. 2 is a schematic cross-sectional view of an indoor unit equipped with the cross flow fan pertaining to the embodiments of the present invention.

The indoor unit 1, which is shown in FIG. 2, is a wall-mounted indoor unit attached to a wall surface or the like in a room and is mainly equipped with an indoor unit casing 5, an indoor heat exchanger 8, and a cross flow fan 10.

The indoor heat exchanger 8 and the cross flow fan 10 are housed in the indoor unit casing 5. Furthermore, air inlets 6 and an air outlet 4 for air conditioning are formed in the indoor unit casing 5.

The air inlets 6 are disposed in the upper portion and the front portion of the indoor unit casing 5 and are openings for taking room air into the inside of the indoor unit casing 5.

The air outlet 4 is disposed in the lower portion of the front surface of the indoor unit casing 5. Furthermore, a horizontal flap 7 is disposed in the neighborhood of the air outlet 4 in such a way as to cover the air outlet 4. The horizontal flap 7 is driven to rotate by a flap motor (not shown in the drawings), changes the direction in which the air is guided, and opens and closes the air outlet 4.

The indoor heat exchanger 8 comprises a heat transfer tube that is folded back plural times at both lengthwise direction ends and plural fins that are inserted from the heat transfer tube, and the indoor heat exchanger 8 performs heat exchange with air coming into contact with it. Furthermore, the indoor heat exchanger 8 functions as a condenser during a heating operation and functions as an evaporator during a cooling operation.

Figure 4:
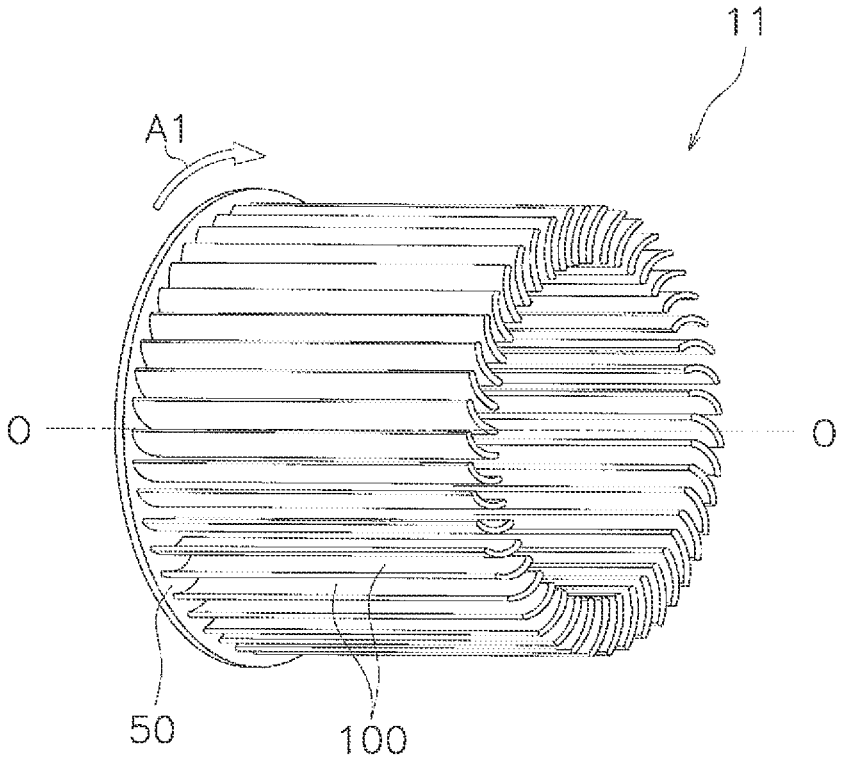
FIG. 4 is a perspective view showing an impeller.

The cross flow fan 10 has a motor (not shown in the drawings) that serves as a drive mechanism and impellers 11 that are driven to rotate by the motor in the direction of arrow A1 shown in FIG. 4. Furthermore, the cross flow fan 10 is disposed in such a way that it can suck air into the indoor unit casing 5 from the air inlets 6, cause the air to pass through the indoor heat exchanger 8, and thereafter blow out the air to the outside of the indoor unit casing 5 from the air outlet 4. Specifically, the cross flow fan 10 is disposed between the indoor heat exchanger 8 and the air outlet 4 in the flow direction of the air inside the indoor unit casing 5. Furthermore, a guide portion 9 is disposed on the back side of the impellers 11. The guide portion 9 guides, to the air outlet 4, the air flow that has flowed through the impellers 11 from a space S1 between the indoor heat exchanger 8 and the impellers 11 and has thereafter been blown out into a space S2 between the impellers 11 and the air outlet 4. Moreover, a tongue portion 15 for preventing the air flow that has been blown out into the space S2 from flowing back into the space S1 is disposed on the front side of the impellers 11.

In this way, the indoor unit 1 can, by driving the impellers 11 of the cross flow fan 10 to rotate, produce an air flow leading from the space S1 to the space S2, which is a flow wherein the air inside the indoor unit casing 5 flows through the impellers 11 orthogonal to an axis of rotation O of the impellers 11 and is blown out from the air outlet 4. Because of this, in the indoor unit 1, the air becomes sucked into the indoor unit casing 5 from the air inlets 6, and the air that has been sucked into the indoor unit casing 5 is cooled or heated as a result of passing through the indoor heat exchanger 8, travels through the impellers 11 of the cross flow fan 10, and is blown out to the outside of the indoor unit casing 5 from the air outlet 4.

Next, the configuration of the impellers 11 of the cross flow fan 10 will be described.

<Configuration of Impellers>

Figure 3:
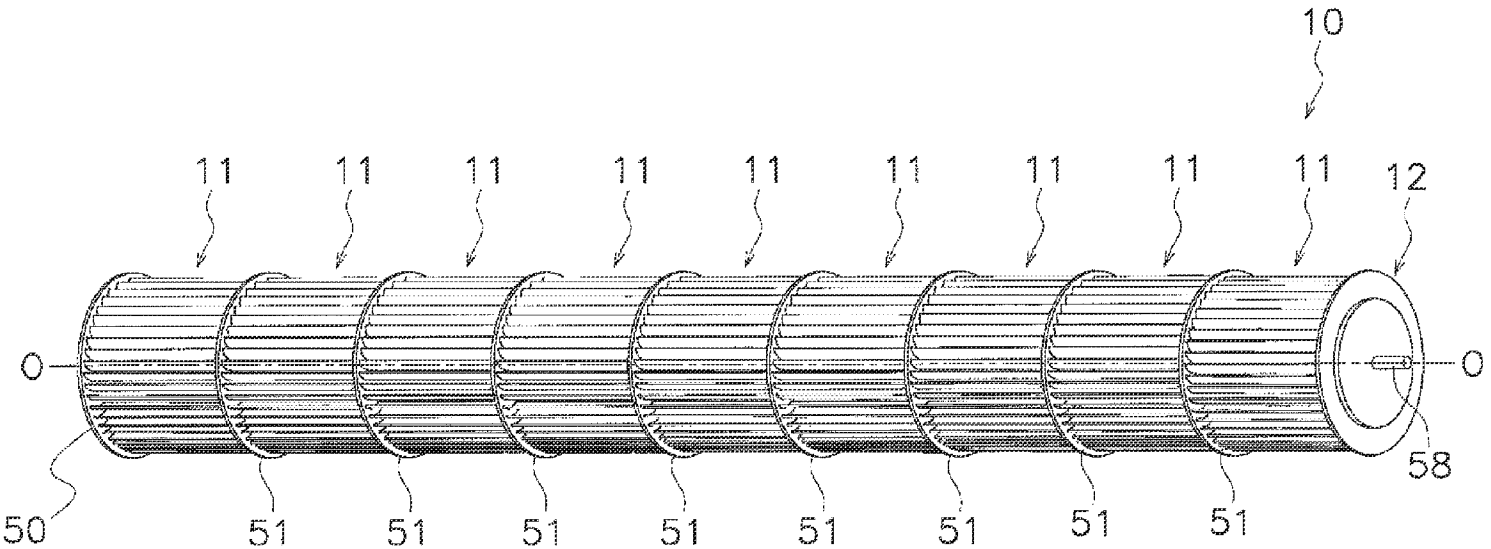
FIG. 3 is an external perspective view of the cross flow fan pertaining to the embodiments of the present invention.

As shown in FIG. 3, the cross flow fan 10 has a rotor-like external shape that is long and narrow in a rotational axis direction, which is the direction of the axis of rotation O of the cross flow fan 10. Furthermore, the cross flow fan 10 mainly has a disc-shaped circular support plate 12 that is disposed on a first end face, a disc-shaped circular support plate 50 that is disposed on a second end face, the plural impellers 11, and disc-shaped circular support plates 51 that are disposed between the plural impellers 11, and the cross flow fan 10 is configured as a result of these being joined to one another. The circular support plate 12 configures a first end in the rotational axis direction, and the disc-shaped circular support plate 50 configures a second end in the rotational axis direction. The circular support plate 12 rotates about a rotating shaft (that is, the axis of rotation O) of the impellers 11. Furthermore, a shaft portion 58 that serves as a rotating shaft of the cross flow fan 1 is disposed in the center of the circular support plate 12.

Furthermore, the plural impellers 11 are disposed in a number more than one (here, nine) between the disc-shaped circular support plate 12 disposed on the first end face and the disc-shaped circular support plate 50 disposed on the second end face.

As shown in FIG. 3 and FIG. 4, plural blades 100 are disposed on the disc-shaped circular support plate 50, and the circular support plate 50 rotates about the rotating shaft (that is, the axis of rotation O) of the cross flow fan 10. Furthermore, the plural blades 100 are disposed in a circumferential direction of the circular support plate 50. Furthermore, the blades 100 are disposed on the circular support plate 50 in such a way as to be inclined a predetermined angle in the rotational direction of the cross flow fan 10 (here, the direction of A1 shown in FIG. 4).

In the present invention, other configurations excluding the configurations of the blades have the same structures in all of the embodiments, so in each embodiment below, description relating to other configurations will be omitted and only the configurations of the blades will be described.

<Configuration of Blade>

Figure 5:
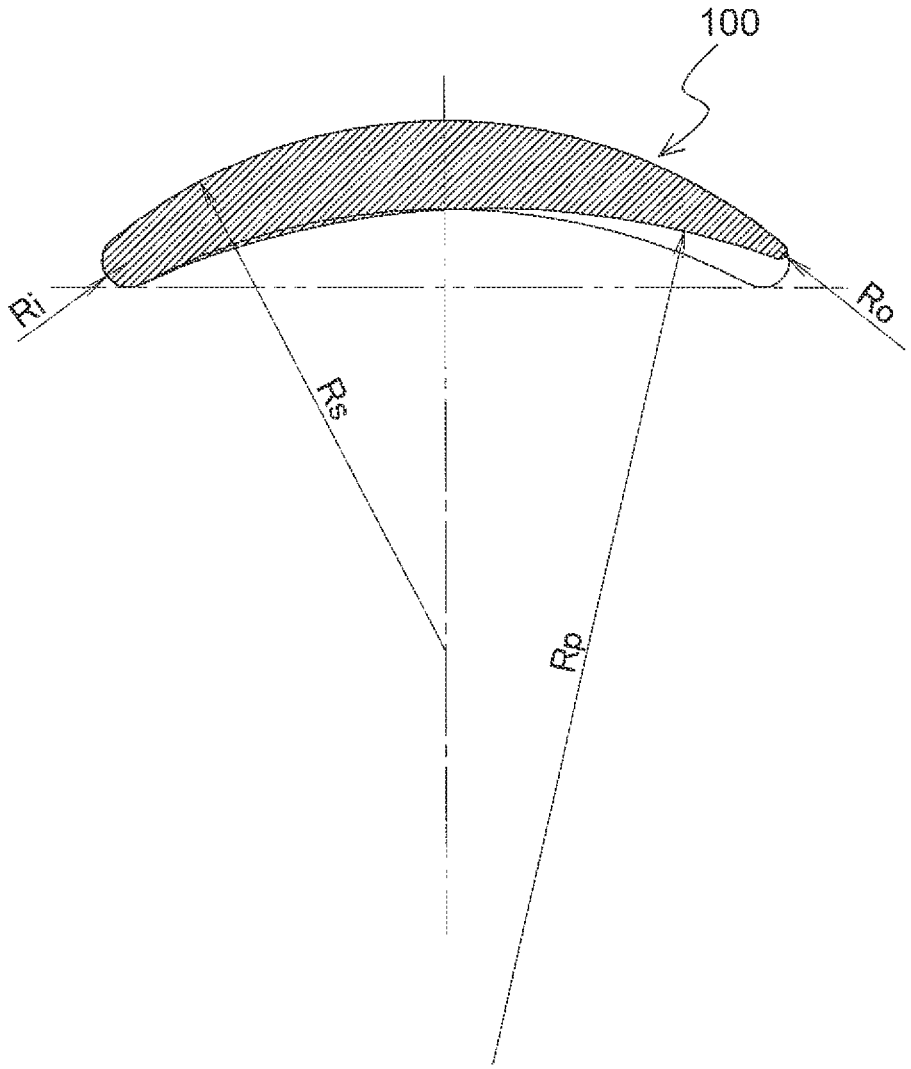
FIG. 5 is a schematic cross-sectional view of a blade of embodiment 1.
Figure 6:
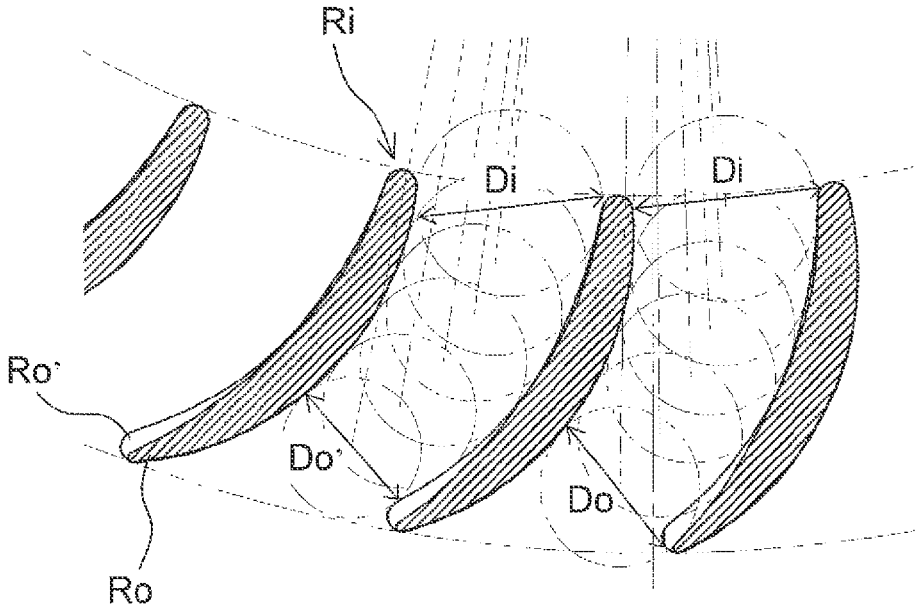
FIG. 6 is a schematic cross-sectional view showing flow paths between plural blades comprising the blade of embodiment 1.

As shown in FIG. 4 to FIG. 6, the blades 100 pertaining to embodiment 1 are disposed in a plurality at predetermined intervals on the circular support plate 50. A lengthwise direction cross-sectional shape of each of the blades has a suction surface arc Rs that forms a convex suction surface, a pressure surface arc Rp that forms a concave pressure surface, an inner peripheral side arc Ri that interconnects a first end of the suction surface arc Rs and a first end of the pressure surface arc Rp, and an outer peripheral side arc Ro that interconnects a second end of the suction surface arc Rs and a second end of the pressure surface arc Rp. A radius rp of the pressure surface arc Rp is greater than a radius rs of the suction surface arc Rs, and a radius ri of the inner peripheral side arc Ri is greater than a radius ro of the outer peripheral side arc Ro. Furthermore, a region of maximum thickness of the blade is located in a position 40% to 60% from the inner peripheral side arc Ri in the lengthwise direction. The blades 100 are disposed in such a way that the inner peripheral side arcs Ri are positioned on an inner peripheral side of the support plate and the outer peripheral side arcs Ro are positioned on an outer peripheral side of the support plate, and the blades have a structure wherein a flow path width between the plural blades gradually decreases from the inner peripheral side toward the outer peripheral side of the support plate.

<Characteristics>

Figure 7:
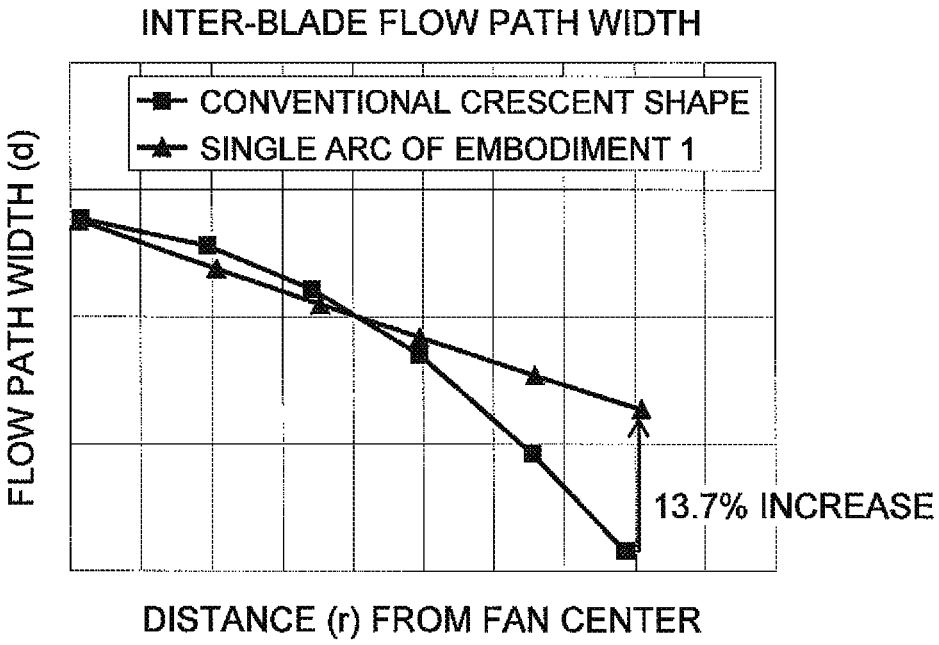
FIG. 7 is a schematic drawing showing a change in flow path width between the plural blades comprising the blade of embodiment 1.
Figure 13A:
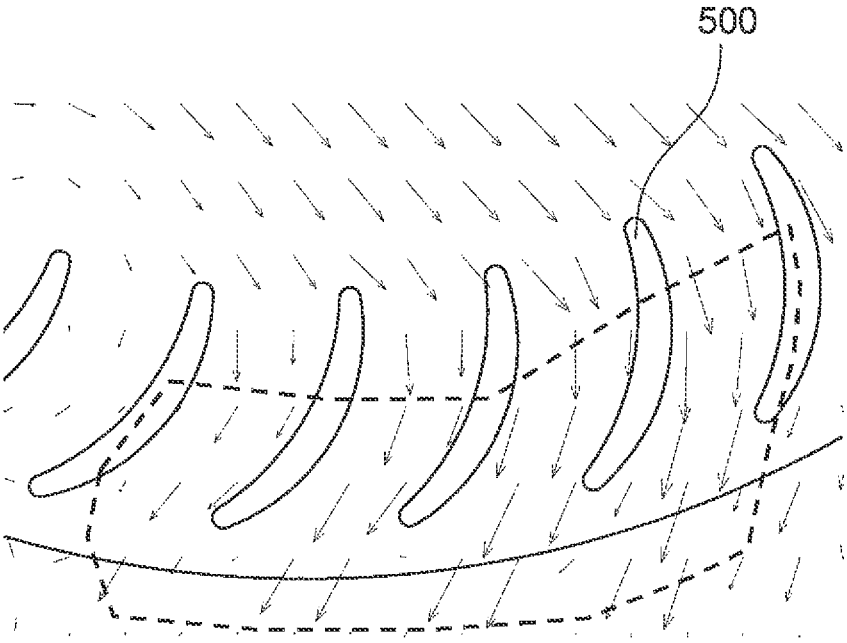
(Prior Art) FIG. 13a
FIG. 13*a* is a schematic drawing showing relative velocities between plural blades comprising the conventional crescent-shaped blade.

In the blade 100 pertaining to embodiment 1, the radius rp of the pressure surface arc Rp is greater than the radius rs of the suction surface arc Rs, and the radius ri of the inner peripheral side arc Ri is greater than the radius ro of the outer peripheral side arc Ro. That is, ri>ro and rp>rs. As a result, in the blade 100 shown in FIG. 5, part of the thickness of the pressure surface on the outer peripheral side becomes thinner, and compared to the blade 500 whose cross section has a crescent shape and which is shown in FIG. 13*a*, the thickness of the pressure surface on the outer peripheral side of the blade 100 is cut. As a result, as shown in FIG. 6, a flow path diameter Di on the inner peripheral side of the blades 100 is decreased to a flow path diameter Do on the outer peripheral side of the blades. However, because the thickness of the pressure surface on the outer peripheral side of each of the blades 100 is cut, the flow path diameter Do on the outer peripheral side of the blades 100 is greater compared to the flow path diameter Do' on the outer peripheral side of the conventional blades 500 whose cross section has a crescent shape. Consequently, the change in the flow path width from the inner peripheral side to the outer peripheral side of the blade 100 pertaining to embodiment 1 is smaller than the change in the flow path width from the inner peripheral side to the outer peripheral side of the conventional crescent-shaped blade 500, and the change in speed also becomes smaller. Specifically, as shown in FIG. 7, the maximum percentage decrease of the flow path width between the plural blades on the outer peripheral side of the blade 100 pertaining to embodiment 1 is 20% or less and is 13.7% greater than that of the flow path width from the inner peripheral side to the outer peripheral side of the blade 500. As a result, the increase in flow velocities becomes smaller on the outlet side, and thus air flow turbulence becomes smaller and it becomes difficult for flow separation to occur on the outlet side suction surface. As a result, power loss caused by the fan decreases.

Embodiment 2

Configuration of Blade

Figure 8:
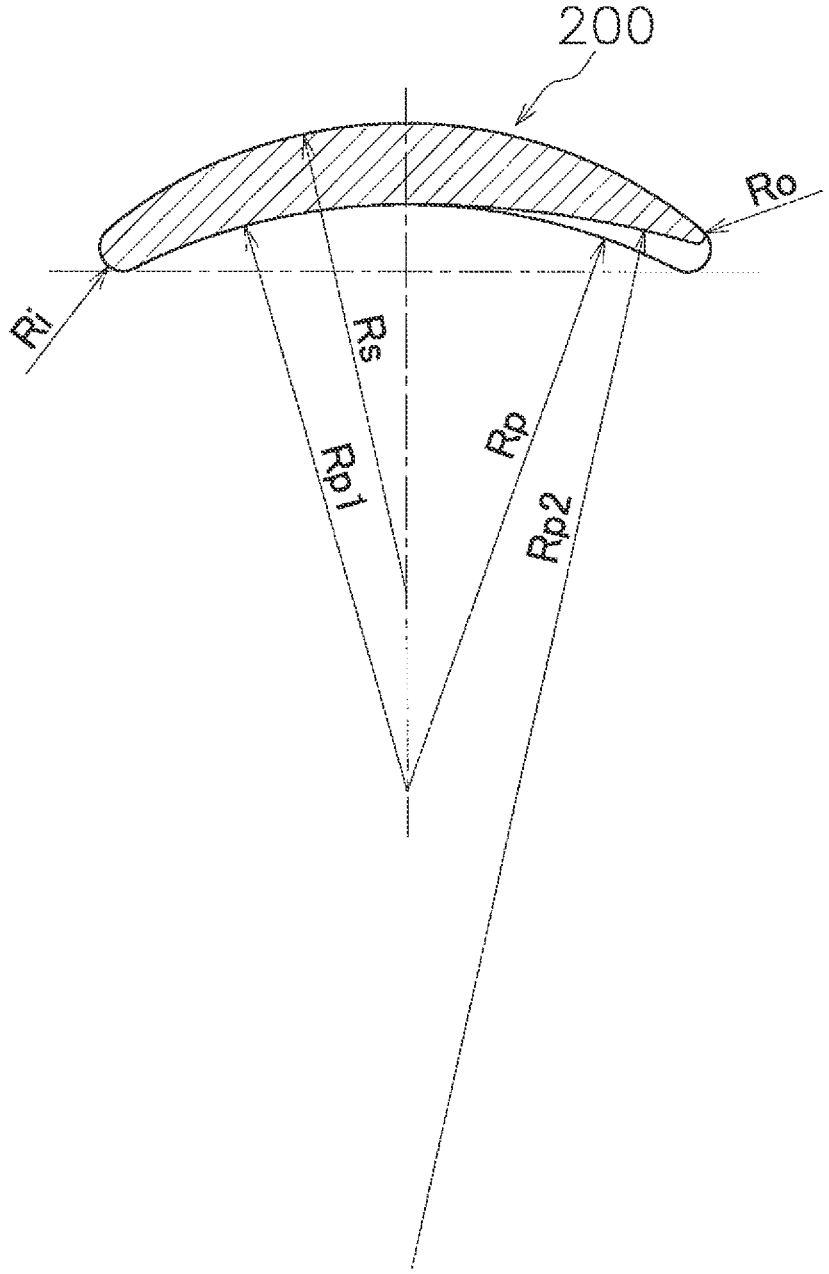
FIG. 8 is a schematic cross-sectional view of a blade of embodiment 2.

As shown in FIG. 8, in a blade 200 pertaining to embodiment 2, the pressure surface arc Rp is configured by two arcs. The pressure surface arc Rp is configured by a first pressure surface arc Rp1 positioned on the inner peripheral side and a second pressure surface arc Rp2 positioned on the outer peripheral side; a radius rp1 of the first pressure surface arc Rp1 positioned on the inner peripheral side and a radius rp2 of the second pressure surface arc Rp2 positioned on the outer peripheral side are each greater than the radius rs of the suction surface arc Rs; and the radius rp1 of the first pressure surface arc Rp1 positioned on the inner peripheral side is smaller than the radius rp2 of the second pressure surface arc Rp2 positioned on the outer peripheral side. That is, ri>ro and rp2>rp1>rs. Furthermore, a region of maximum thickness of the blade is located in a position 40% to 60% from the inner peripheral side arc Ri in the lengthwise direction. The blades 200 are disposed in such a way that the inner peripheral side arcs Ri are positioned on an inner peripheral side of the support plate and the outer peripheral side arcs Ro are positioned on an outer peripheral side of the support plate, and the blades have a structure wherein a flow path width between the plural blades gradually decreases from the inner peripheral side toward the outer peripheral side of the support plate.

<Characteristics>

Figure 9:
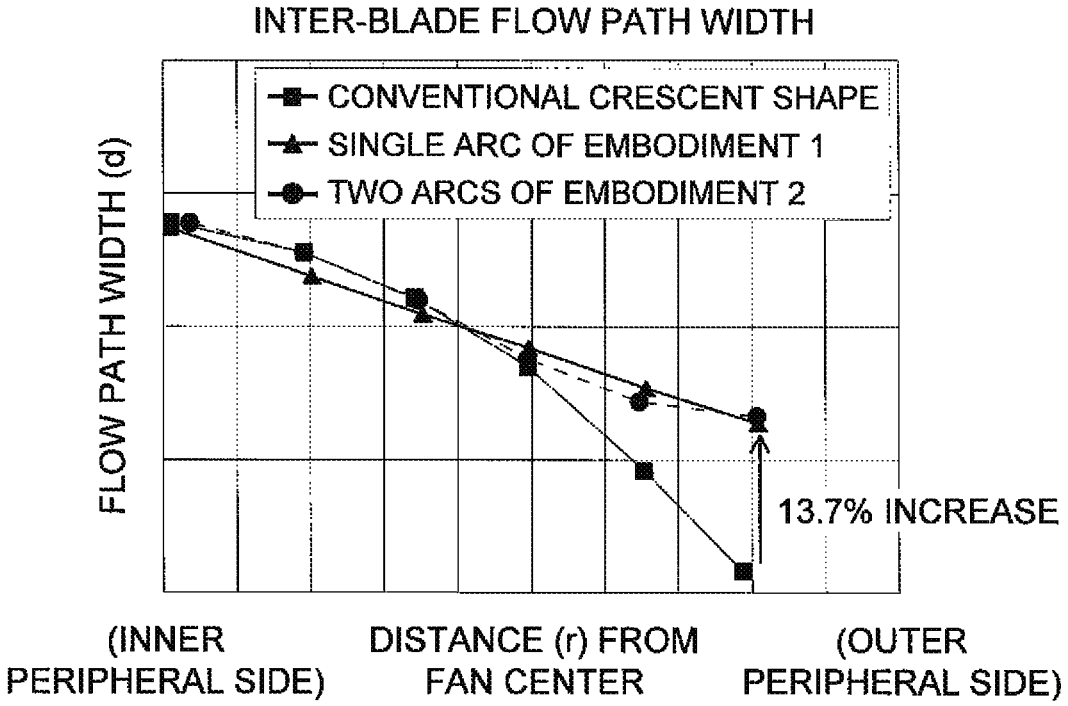
FIG. 9 is a schematic drawing showing a change in flow path width between plural blades comprising the blade of embodiment 2.

In the blade 200 pertaining to embodiment 2, the pressure surface arc Rp is configured by two arcs. As a result, compared to the blade 100 pertaining to embodiment 1 in which the pressure surface arc Rp is configured by a single arc, the thickness of the pressure surface on the outer peripheral side of the blade 200 is cut so as to become even thinner. As a result, the change in the flow path width from the inner peripheral side to the outer peripheral side of the blade 200 pertaining to embodiment 2 becomes even smaller than the change in the flow path width from the inner peripheral side to the outer peripheral side of the conventional crescent-shaped blade 500, and the change in speed also becomes smaller. Specifically, as shown in FIG. 9, the maximum percentage decrease of the flow path width between the plural blades on the outer peripheral side of the blade 200 pertaining to embodiment 2 is 20% or less and is 13.7% greater than that of the flow path width from the inner peripheral side to the outer peripheral side of the blade 500. However, in the blade 200 pertaining to embodiment 2, the decrease in the flow path width is smaller on the inner peripheral side than it is in the blade 100 pertaining to embodiment 1. As a result, in the entire length direction from the inner peripheral side to the outer peripheral side of the blade, air flow turbulence becomes smaller and it becomes difficult for flow separation to occur on the outlet side suction surface. As a result, power loss caused by the fan decreases.

Embodiment 3

Configuration of Blade

Figure 10:
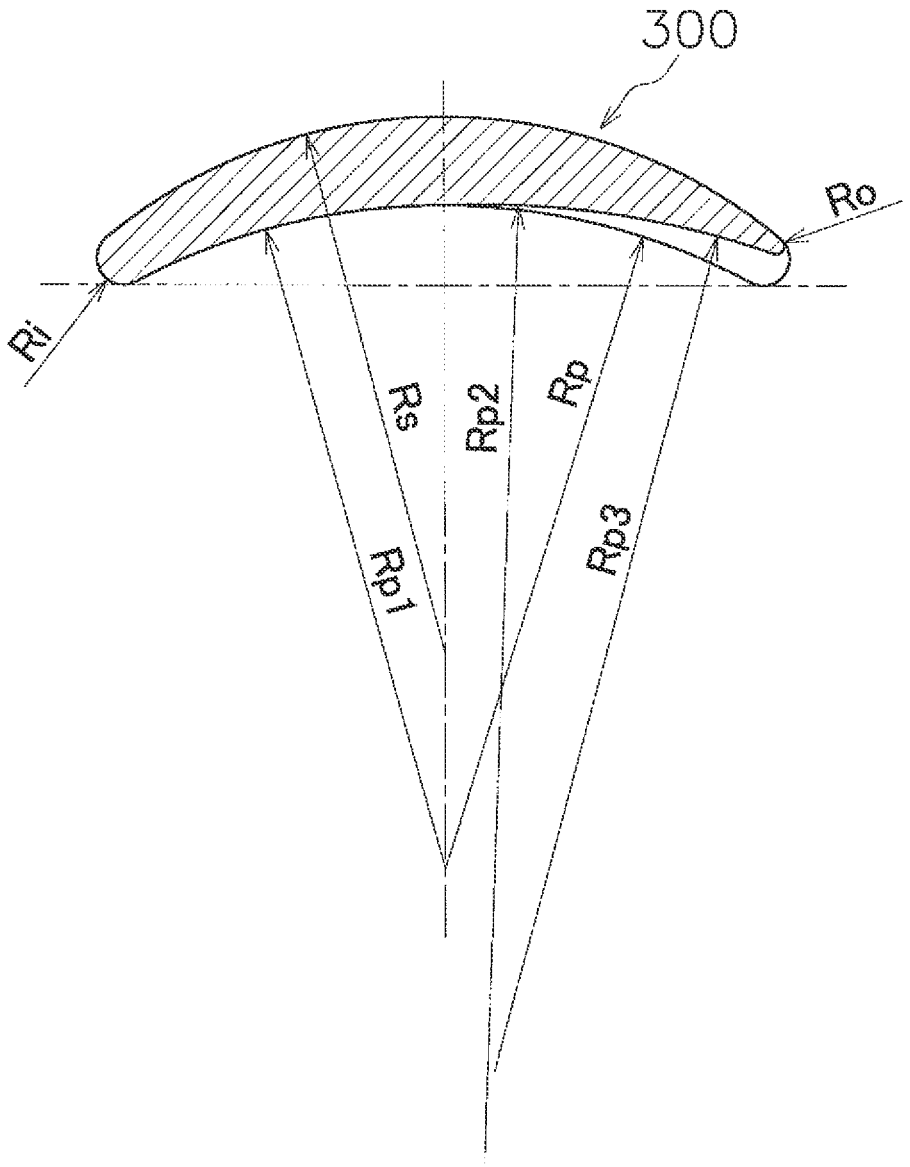
FIG. 10 is a schematic cross-sectional view of a blade of embodiment 3.

As shown in FIG. 10, in a blade 300 pertaining to embodiment 3, the pressure surface arc Rp is configured by three arcs. The pressure surface arc Rp is configured by a first pressure surface arc Rp1 positioned on the inner peripheral side, a third pressure surface arc Rp3 positioned on the outer peripheral side, and a second pressure surface arc Rp2 positioned between the inner peripheral side and the outer peripheral side; a radius rp1 of the first pressure surface arc Rp1 positioned on the inner peripheral side, a radius rp2 of the second pressure surface arc Rp2 positioned between the inner peripheral side and the outer peripheral side, and a radius rp3 of the third pressure surface arc Rp3 positioned on the outer peripheral side are each greater than the radius rs of the suction surface arc Rs; the radius rp1 of the first pressure surface arc Rp1 positioned on the inner peripheral side is smaller than the radius rp3 of the third pressure surface arc Rp3 positioned on the outer peripheral side; and the radius rp2 of the second pressure surface arc Rp2 positioned between the inner peripheral side and the outer peripheral side is greater than the radius rp3 of the third pressure surface arc Rp3 positioned on the outer peripheral side. That is, ri>ro and rp2>rp3>rp1>rs. Furthermore, a region of maximum thickness of the blade is located in a position 40% to 60% from the inner peripheral side arc Ri in the lengthwise direction. The blades 300 are disposed in such a way that the inner peripheral side arcs Ri are positioned on an inner peripheral side of the support plate and the outer peripheral side arcs Ro are positioned on the outer peripheral side of the support plate, and the blades have a structure wherein a flow path width between the plural blades gradually decreases from the inner peripheral side toward the outer peripheral side of the support plate.

<Characteristics>

Figure 11:
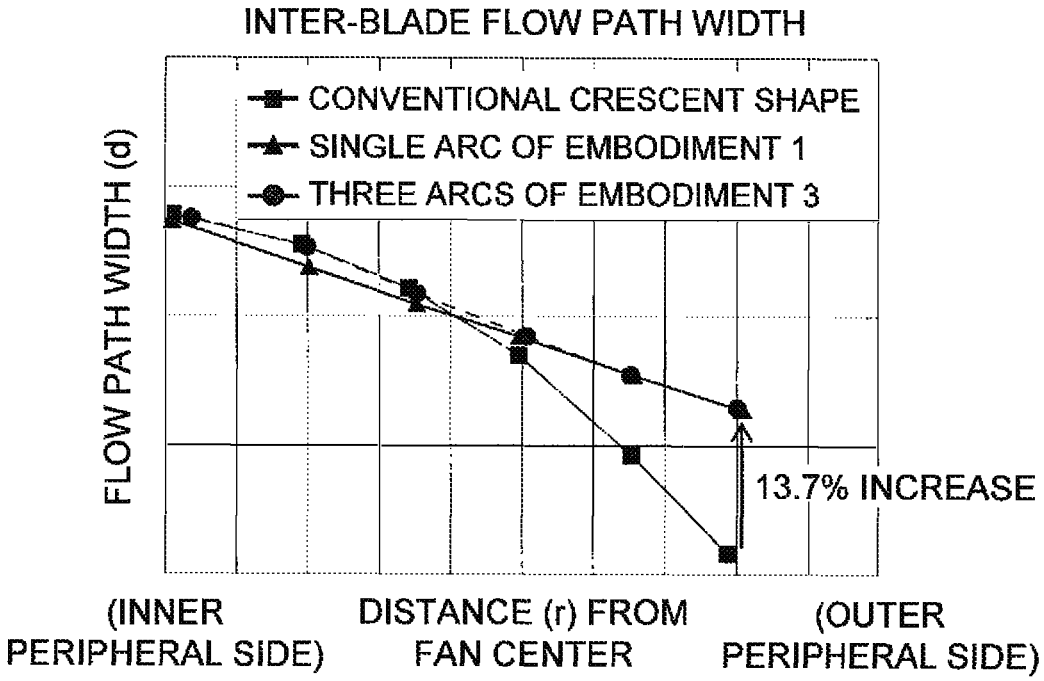
FIG. 11 is a schematic drawing showing a change in flow path width between plural blades comprising the blade of embodiment 3.

In the blade 300 pertaining to embodiment 3, the pressure surface arc Rp is configured by three arcs. As a result, compared to the blade 100 pertaining to embodiment 1 in which the pressure surface arc Rp is configured by a single arc and the blade 200 pertaining to embodiment 2 in which the pressure surface arc Rp is configured by two arcs, the thickness of the pressure surface on the outer peripheral side is cut so as to become even thinner. As a result, the change in the flow path width from the inner peripheral side to the outer peripheral side of the blade 300 pertaining to embodiment 3 becomes even smaller than the change in the flow path width from the inner peripheral side to the outer peripheral side of the conventional crescent-shaped blade 500, and the change in speed also becomes smaller. Specifically, as shown in FIG. 11, the maximum percentage decrease of the flow path width between the plural blades on the outer peripheral side of the blade 300 pertaining to embodiment 3 is 20% or less and is 13.7% greater than that of the flow path width from the inner peripheral side to the outer peripheral side of the blade 500. However, in the blade 300 pertaining to embodiment 3, the decrease in the flow path width is smaller on the inner peripheral side than it is in the blade 100 pertaining to embodiment 1 and the blade 200 pertaining to embodiment 2. As a result, in the entire length direction from the inner peripheral side to the outer peripheral side of the blade, air flow turbulence becomes smaller and it becomes difficult for flow separation to occur on the outlet side suction surface. As a result, power loss caused by the fan decreases.

Advantageous Effects of Invention

The present invention has a structure wherein the thickness of the pressure surface on the outer peripheral side of the blade of the cross flow fan is cut so that the flow path width between the plural blades gradually decreases from the inner peripheral side to the outer peripheral side of the support plate. As a result, in the entire length direction from the inner peripheral side to the outer peripheral side of the blade, air flow turbulence becomes smaller and it becomes difficult for flow separation to occur on the outlet side suction surface. As a result, power loss caused by the fan decreases.

Taking as an example a case where the outer diameter of the cross flow fan 10 is 90 ram, the rotational speed of the cross flow fan 10 is 1200 rpm, and the maximum flow rate is 10.4 $m^3$/min, an experiment was performed in regard to absolute velocities and relative velocities of air flows between the plural blades on the outlet side of the cross flow fan 10 in a case that employed the blade 100 pertaining to embodiment 1 and a case that employed the conventional crescent-shaped blade 500, and the relationship between motor input to the cross flow fan and air volume was also investigated.

Figure 12A:
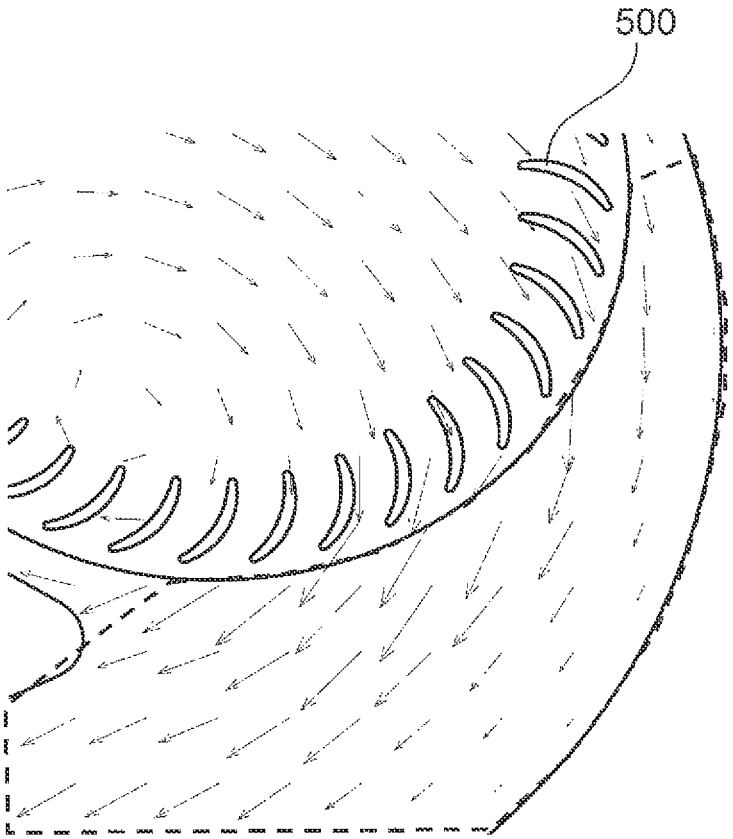
FIG. 12*a* is a schematic drawing showing absolute velocities between plural blades comprising a conventional crescent-shaped blade.
Figure 12B:
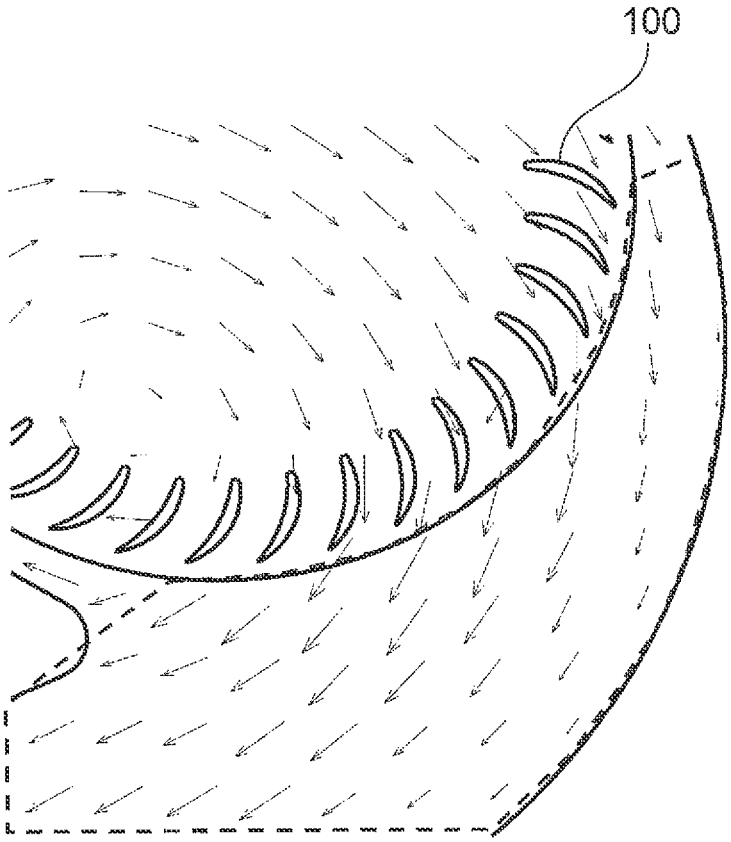
FIG. 12*b* is a schematic drawing showing absolute velocities between plural blades comprising the blade with the shape of embodiment 1.

When the distributions of the fluid velocity vectors obtained from the result of calculating the air flows between the plural blades are expressed by an absolute velocity vector diagram, the result of employing the conventional crescent-shaped blade 500 is as shown in FIG. 12*a*, and the result of employing the blade 100 pertaining to embodiment 1 is as shown in FIG. 12*b*. Here, when the blade 100 pertaining to embodiment 1 was employed, the flow velocities between the plural blades became lower compared to when the conventional crescent-shaped blade 500 was employed, so the flow velocities of the air flows in the air outlet become lower and toss in the outlet flow path can be reduced.

Figure 13B:
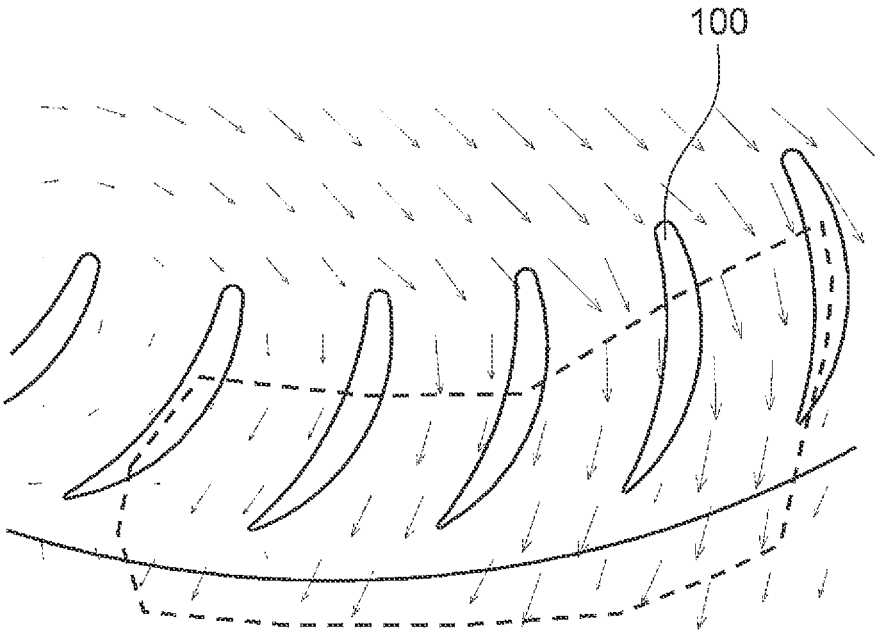
FIG. 13*b* is a schematic drawing showing relative velocities between plural blades comprising the blade with the shape of embodiment 1.

Furthermore, when the distributions of the fluid velocity vectors obtained from the result of calculating the air flows between the plural blades are expressed by a relative velocity vector diagram, the result of employing the conventional crescent-shaped blade 500 is as shown in FIG. 13*a*, and the result of employing the blade 100 pertaining to embodiment 1 is as shown in FIG. 13*b*. Here, when the blade 100 pertaining to embodiment 1 was employed, compared to when the conventional crescent-shaped blade 500 was employed, the flow velocity between the blades can be lowered because the flow path width between the plural blades is wider, and friction and loss caused by flow path reduction can be reduced.

Figure 14:
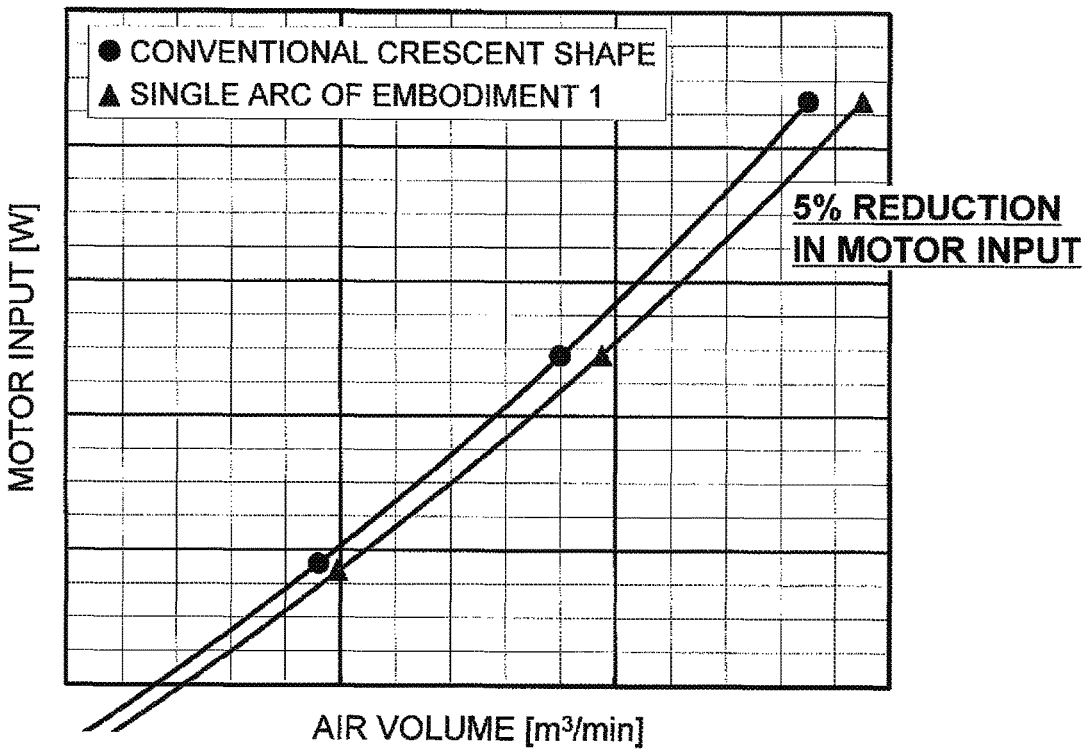
FIG. 14 is a schematic drawing showing the relationship between motor input to the cross flow fan and air volume.
Figure 15:
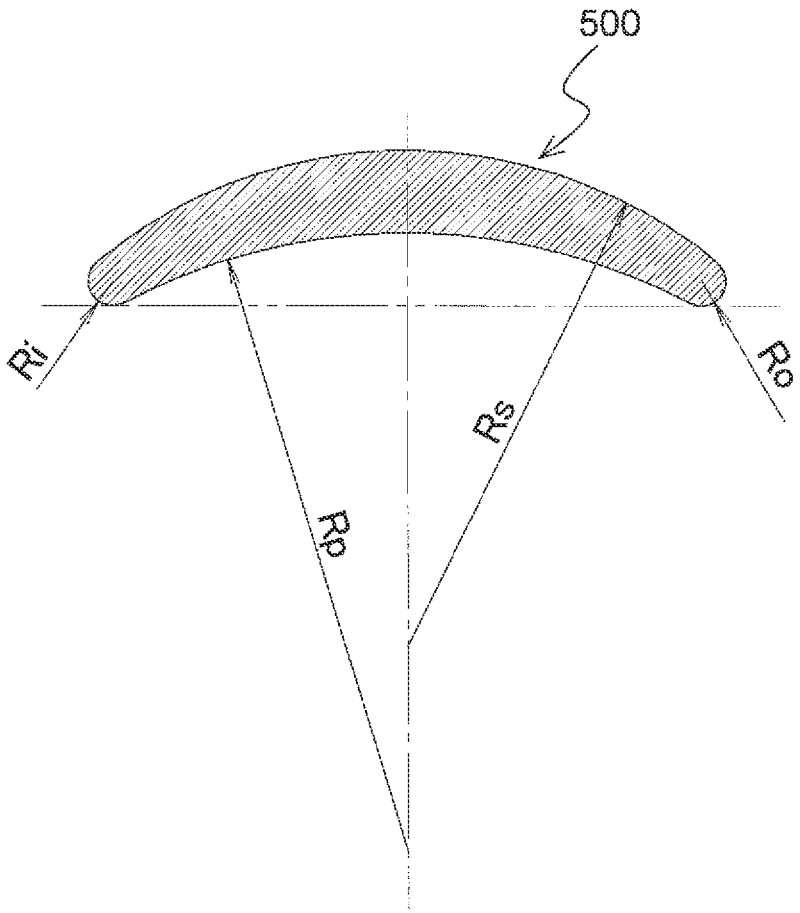
(Prior Art) FIG. 15
FIG. 15 is a schematic cross-sectional view of the conventional crescent-shaped blade.
Figure 16:
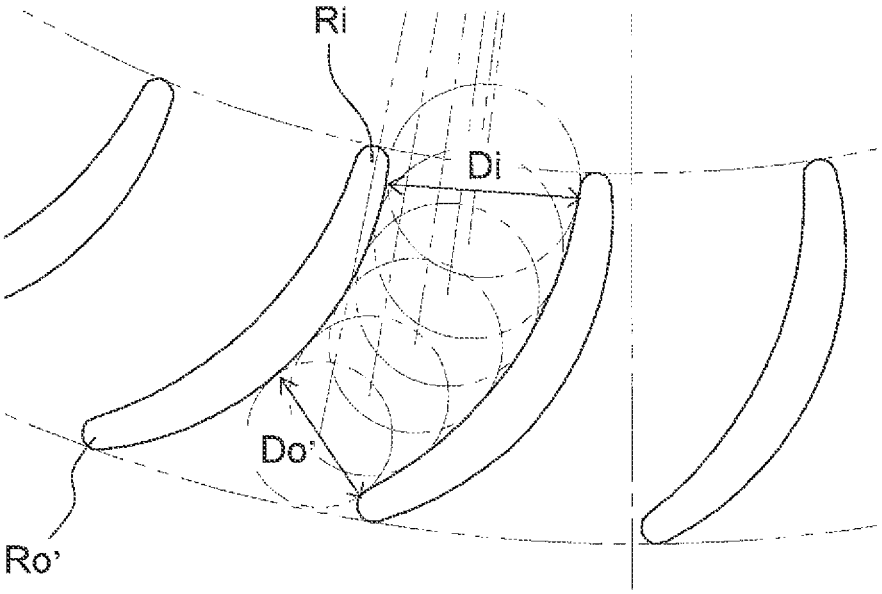
(Prior Art) FIG. 16
FIG. 16 is a schematic cross-sectional view showing flow paths between plural blades comprising the conventional crescent-shaped blade.
Figure 17:
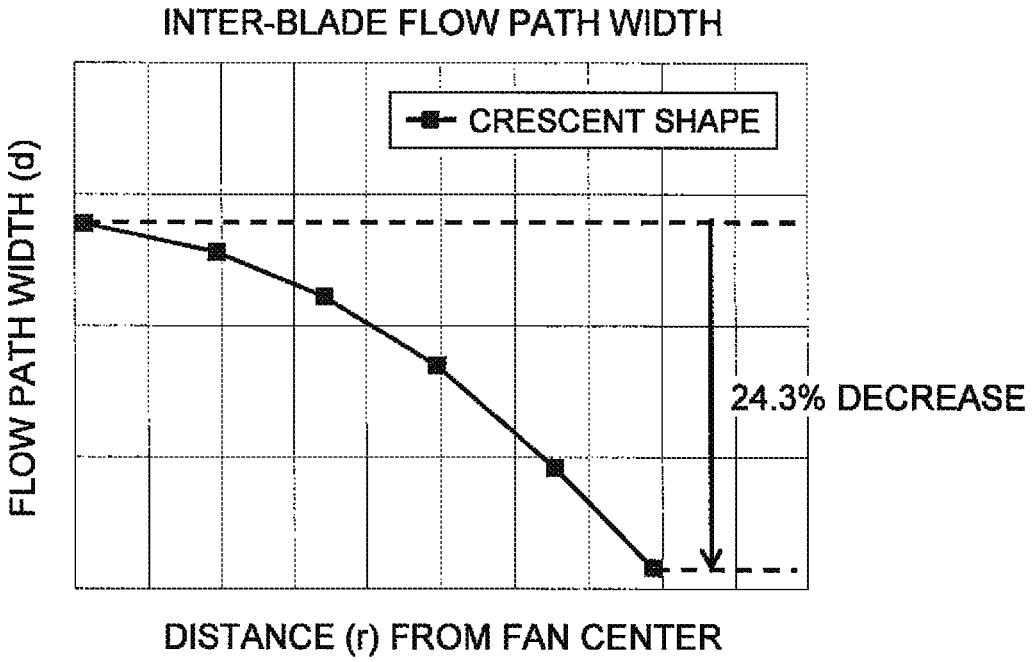
(Prior Art) FIG. 17
FIG. 17 is a schematic drawing showing a change in flow path width between the plural blades comprising the conventional crescent-shaped blade.

Moreover, as for the results of the experiment in regard to the relationship between motor input to the cross flow fan and air volume, as shown in FIG. 14, there was a 5% reduction in motor input in the case that employed the blade 100 pertaining to embodiment 1 compared to the case that employed the conventional crescent-shaped blade 500.

What is claimed is:

1. A cross flow fan comprising:

a support plate; and an impeller including a plurality of blades disposed on the support plate at predetermined intervals a lengthwise direction cross-sectional shape of each of the blades having a suction surface arc that forms a convex suction surface, a pressure surface arc that forms a concave pressure surface, an inner peripheral side arc that interconnects a first end of the suction surface arc and a first end of the pressure surface are, and an outer peripheral side arc that interconnects a second end of the suction surface arc and a second end of the pressure surface arc, a radius of the pressure surface arc being greater than a radius of the suction surface arc, a radius of the inner peripheral side arc being greater than a radius of the outer peripheral side arc and a region of maximum thickness of the blade being located in a position 40% to 60% from the inner peripheral side arc in the lengthwise direction, to obtain low air turbulence and reduce power loss of the cross flow fan, the blades being disposed such that the inner peripheral side arcs are positioned on an inner peripheral side of the support plate and the outer peripheral side arcs are positioned on an outer peripheral side of the support plate, and a flow path width between the plurality of blades gradually decreasing from the inner peripheral side toward the outer peripheral side of the support plate.

2. The cross flow fan according to claim 1, wherein the suction surface of each of the blades is formed by a single suction surface arc, the pressure surface of each of the blades is formed by a plurality of pressure surface arcs, and the radius of each of the plurality of pressure surface arcs is greater than the radius of the suction surface arc of the blade.

3. The cross flow fan according to claim 2, wherein a size of the radius of each of the plurality of pressure surface arcs is dimensioned such that the size of the radius decrease in stages, and the thickness of each of the blades becomes smaller in stages from the region of maximum thickness toward the outer peripheral side arc of the blade.

4. The cross flow fan according to claim 3, wherein a maximum percentage decrease of the flow path width between each of the plurality of blades is 20%.

5. The cross flow fan according to claim 2, wherein a maximum percentage decrease of the flow path width between each of the plurality of blades is 20%.

6. The cross flow fan according to claim 1, wherein a maximum percentage decrease of the flow path width between each of the plurality of blades is 20%.

7. An air conditioning apparatus indoor unit comprising:
a cross flow fan including:
a support plate; and
an impeller including a plurality of blades disposed on the support plate at predetermined intervals, a lengthwise direction cross-sectional shape of each of the blades having
a suction surface arc that forms a convex suction surface,
a pressure surface arc that forms a concave pressure surface,
an inner peripheral side arc that interconnects a first end of the suction surface arc and a first end of the pressure surface arc, and
an outer peripheral side arc that interconnects a second end of the suction surface arc and a second end of the pressure surface arc,
a radius of the pressure surface arc being greater than a radius of the suction surface arc,
a radius of the inner peripheral side arc being greater than a radius of the outer peripheral side arc, and
a region of maximum thickness of the blade being located in a position 40% to 60% from the inner peripheral side arc in the lengthwise direction, to obtain low air turbulence and reduce power loss of the cross flow fan,
the blades being disposed such that the inner peripheral side arcs are positioned on an inner peripheral side of the support plate and the outer peripheral side arcs are positioned on an outer peripheral side of the support plate, and
a flow path width between the plurality of blades gradually decreasing from the inner peripheral side toward the outer peripheral side of the support plate,
the air conditioning unit further comprising:
a heat exchanger; and
a casing.

8. An air conditioning apparatus comprising:
an air conditioning apparatus indoor unit including a cross flow fan, the cross flow fan including:
a support plate; and
an impeller including a plurality of blades disposed on the support plate at predetermined intervals, a lengthwise direction cross-sectional shape of each of the blades having
a suction surface arc that forms a convex suction surface,
a pressure surface arc that forms a concave pressure surface,
an inner peripheral side arc that interconnects a first end of the suction surface arc and a first end of the pressure surface are, and
an outer peripheral side arc that interconnects a second end of the suction surface arc and a second end of the pressure surface arc,
a radius of the pressure surface arc being greater than a radius of the suction surface arc,
a radius of the inner peripheral side arc being greater than a radius of the outer peripheral side arc, and
a region of maximum thickness of the blade being located in a position 40% to 60% from the inner peripheral side arc in the lengthwise direction, to obtain low air turbulence and reduce Dower loss of the cross flow fan,
the blades being disposed such that the inner peripheral side arcs are positioned on an inner peripheral side of the support plate and the outer peripheral side arcs are positioned on an outer peripheral side of the support plate, and
a flow path width between the pluralities of blades gradually decreasing from the inner peripheral side toward the outer peripheral side of the support plate,
the air conditioning apparatus further comprising:
an outdoor unit; and
a pipe interconnecting the air conditioning apparatus indoor unit and the outdoor unit.

* * * * *